US010374310B2

(12) United States Patent
Chang et al.

(10) Patent No.: US 10,374,310 B2
(45) Date of Patent: Aug. 6, 2019

(54) TUNABLE ANTENNA DEVICE

(71) Applicant: Compal Electronics, Inc., Taipei (TW)

(72) Inventors: En-Tsao Chang, Taipei (TW); Yi-Da Chen, Taipei (TW); Yi-Hsin Tsai, Taipei (TW)

(73) Assignee: Compal Electronics, Inc., Taipei (TW)

( * ) Notice: Subject to any disclaimer, the term of this patent is extended or adjusted under 35 U.S.C. 154(b) by 240 days.

(21) Appl. No.: 15/613,280

(22) Filed: Jun. 5, 2017

(65) Prior Publication Data

US 2017/0352955 A1 Dec. 7, 2017

Related U.S. Application Data

(60) Provisional application No. 62/346,473, filed on Jun. 6, 2016.

(51) Int. Cl.

| | |
|---|---|
| ***H01Q 5/30*** | (2015.01) |
| ***H01Q 5/328*** | (2015.01) |
| ***H01Q 1/22*** | (2006.01) |
| ***H01Q 1/50*** | (2006.01) |
| *H01Q 1/24* | (2006.01) |

(52) U.S. Cl.

CPC ..... *H01Q 5/328* (2015.01); *H01Q 1/2283* (2013.01); *H01Q 1/50* (2013.01); *H01Q 1/243* (2013.01)

(58) Field of Classification Search

CPC ..... H01Q 1/22; H01Q 1/243; H01Q 1/38; H01Q 1/50; H01Q 5/30–5/40

See application file for complete search history.

(56) References Cited

U.S. PATENT DOCUMENTS

| | | | | |
|---|---|---|---|---|
| 2001/0048386 | A1* | 12/2001 | Edmonson | G01S 13/755 342/42 |
| 2005/0099356 | A1* | 5/2005 | Durham | H01Q 1/38 343/795 |
| 2012/0026064 | A1* | 2/2012 | Lee | H01Q 9/16 343/860 |

FOREIGN PATENT DOCUMENTS

| | | |
|---|---|---|
| TW | M307200 | 3/2007 |
| TW | M513467 | 12/2015 |

* cited by examiner

*Primary Examiner* — Dameon E Levi
*Assistant Examiner* — Hasan Z Islam

(57) ABSTRACT

A tunable antenna device includes a substrate, a switch, a control circuit, an antenna and a frequency adjustment portion. The substrate includes first and second surfaces and first and second through-holes. The switch is on the first surface and includes first, second and first control terminals. The control circuit is on the first surface and electrically coupled to the first control terminal. The antenna is on the second surface and includes first and second radiation members. The frequency adjustment portion is on the second surface and includes first and second metal portions. The first metal portion includes a first interdigital structure electrically coupled to the first radiation member. The second metal portion includes second and third interdigital structures electrically coupled to the second radiation member. The second and third interdigital structures are electrically coupled to the first and second terminals through the first and second through-holes respectively.

14 Claims, 7 Drawing Sheets

TUNABLE ANTENNA DEVICE

FIELD OF THE INVENTION

The present invention relates to an antenna device, and more particularly to a tunable antenna device.

BACKGROUND OF THE INVENTION

With the extensive application of communication technology and for increasing the speed of uploading and downloading of data on mobile devices, long term evolution (LTE) communication technology, the next generation of communication systems, has been rapidly applied to people's lives. In response to the development of 4G communication systems, not only the original 2G/3G but also the new 4G communication bands are required to be compatible; therefore, the number of antennas in the mobile device and the corresponding bandwidth must be increased.

In addition, because today's mobile device is developed to have a compact size, the design of its antenna must also consider the accommodating space. Therefore, how to allow the antenna in a limited accommodating space to cover a wider range of bandwidth is an urgent issue needed to be solved.

SUMMARY OF THE INVENTION

One objective of the present invention is to provide a tunable antenna device which can support a wide band operation while having an advantage of compact size.

The present invention provides a tunable antenna device, which includes a substrate, a first switch, a control circuit, an antenna and a frequency adjustment portion. The substrate includes a first surface, a second surface, a first through-hole and a second through-hole. The first switch is disposed on the first surface and includes a first terminal, a second terminal and a first control terminal. The control circuit is disposed on the first surface and electrically coupled to the first control terminal. The antenna is disposed on the second surface. The antenna includes a first radiation member and a second radiation member. One of the first radiation member and the second radiation member includes a ground terminal, and the other of the first radiation member and the second radiation member includes a feeding terminal. The frequency adjustment portion is disposed on the second surface. The frequency adjustment portion includes a first metal portion and a second metal portion. The first metal portion includes a first interdigital structure. The first interdigital structure is electrically coupled to the first radiation member. The second metal portion includes a second interdigital structure and a third interdigital structure. The first interdigital structure is disposed between the second interdigital structure and the third interdigital structure. The third interdigital structure is electrically coupled to the second radiation member. The second interdigital structure and the third interdigital structure are electrically coupled to the first terminal and the second terminal through the first through-hole and the second through-hole, respectively.

In summary, the present invention adjusts the total number of used interdigital structures of a frequency adjustment portion by controlling the on/off state of a switch to result in a change in coupling capacitance, thereby shifting the frequency band of a tunable antenna device. Therefore, the tunable antenna device has a wider frequency band (for example, a frequency band that covers the LTE bands in Europe and the United States) and has a compact size.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
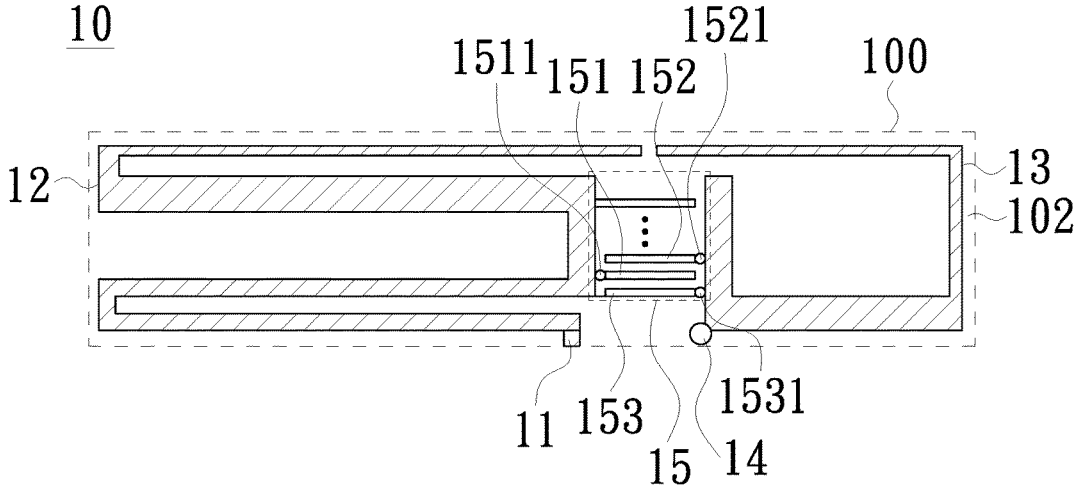
FIG. 1A is a top view diagram of a tunable antenna device in accordance with an embodiment of the present invention.
Figure 1B:
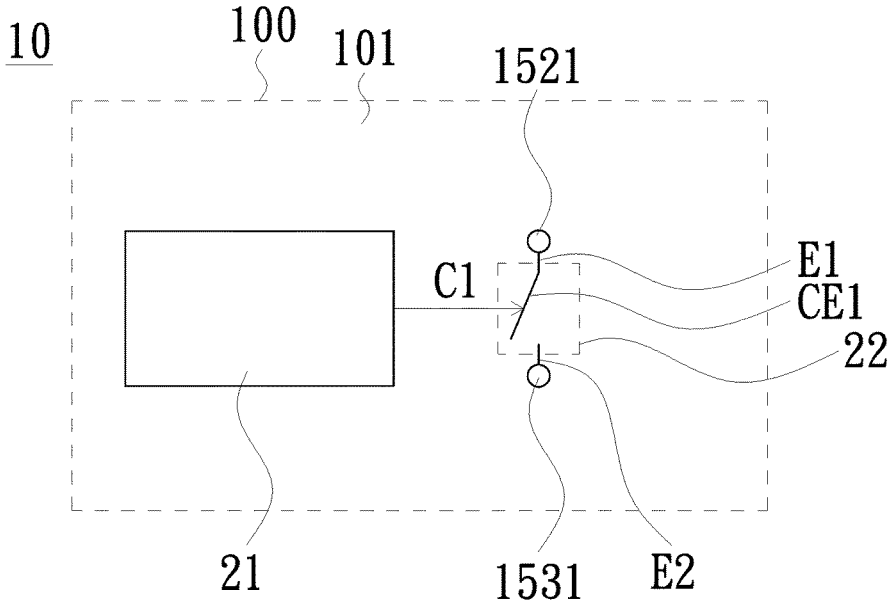
FIG. 1B is a bottom view diagram of a tunable antenna device in accordance with an embodiment of the present invention.

FIG. 1A is a top view diagram of a tunable antenna device in accordance with an embodiment of the present invention. FIG. 1B is a bottom view diagram of a tunable antenna device in accordance with an embodiment of the present invention. Please refer to FIGS. 1A and 1B. The tunable antenna device 10 of the embodiment includes a substrate 100, a control circuit 21, a first switch 22, an antenna (constituted by a first radiation member 12 and a second radiation member 13) and a frequency adjustment portion 15. The substrate 100 has a first surface 101, a second surface 102, a first through-hole 1521 and a second through-hole 1531. The antenna and the frequency adjustment portion 15 are disposed on the second surface 102 of the substrate 100. The frequency adjustment portion 15 is preferably an interdigital capacitor. In addition, one of the first radiation member 12 and the second radiation member 13 has a ground terminal 11, and the other of the first radiation member 12 and the second radiation member 13 has a feeding terminal 14. The control circuit 21 and the first switch 22 are disposed on the first surface 101 of the substrate 100. The first switch 22 has a first terminal E1, a second terminal E2 and a first control terminal CE1. The first terminal E1 and the second terminal E2 are electrically coupled to the first through-hole 1521 and the second through-hole 1531, respectively. The control circuit 21 is electrically coupled the first control terminal CE1 to output a first control signal C1 to control the on/off state of the first switch 22. One end of the first control terminal CE1 is electrically connected to the first terminal E1. When the first switch 22 is turned on, the other end of the first control terminal CE1 is electrically connected to the second terminal E2.

Figure 2:
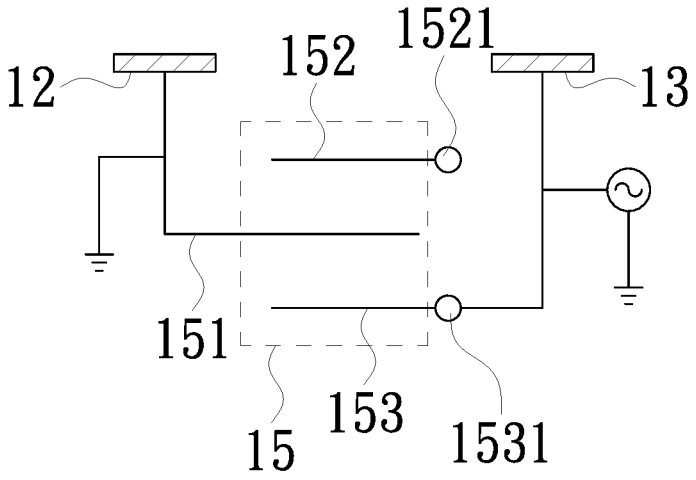
FIG. 2 is a schematic diagram of the circuit layout of the surface of the substrate of the tunable antenna device shown in FIG. 1A.

FIG. 2 is a schematic diagram of the circuit layout of the surface of the substrate of the tunable antenna device shown in FIG. 1A in accordance with an embodiment of the present invention. Please refer to FIG. 2. In the embodiment, the frequency adjustment portion 15 is constituted by a first metal portion and a second metal portion. The first metal portion has a first interdigital structure 151, and the first interdigital structure 151 is electrically coupled to the first radiation member 12. The second metal portion has a second interdigital structure 152 and a third interdigital structure 153, and the third interdigital structure 153 is electrically coupled to the second radiation member 13. In addition, the first interdigital structure 151 is disposed between the second interdigital structure 152 and the third interdigital structure 153. Please refer to FIGS. 1B and 2. The second interdigital structure 152 and the third interdigital structure 153 are electrically coupled to the first terminal E1 and the second terminal E2 of the first switch 22 through the first through-hole 1521 and the second through-hole 1531, respectively. Therefore, the control circuit 21 can control the on/off state of the first switch 22 by using the first control signal C1 to adjust the total number of the used interdigital structures of the frequency adjustment portion 15, thereby resulting in a change in the coupling capacitance to shift the frequency band of the tunable antenna device.

Figure 3A:
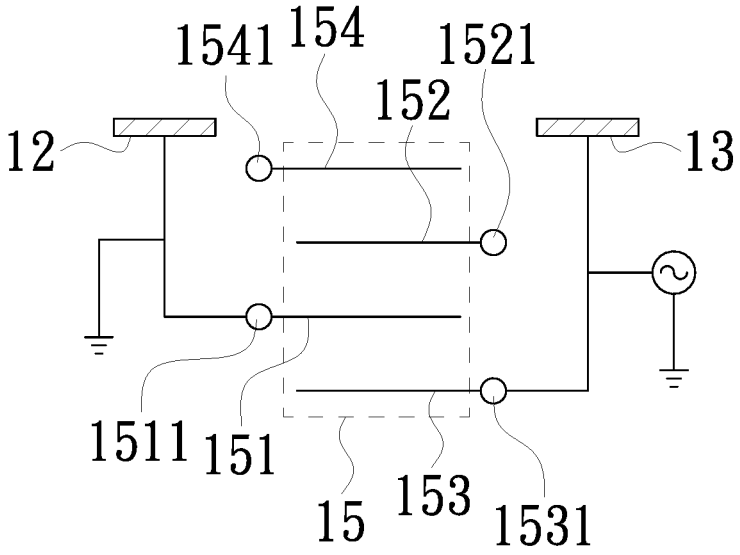
FIGS. 3A and 3B are schematic diagrams of the circuit layout of the two surfaces of a substrate of a tunable antenna device in accordance with another embodiment of the present invention.
Figure 3B:
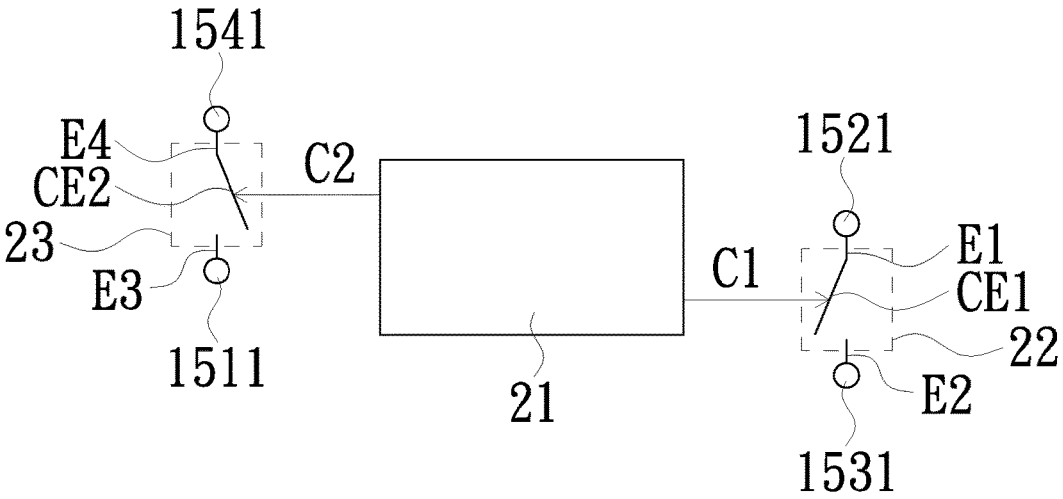

FIGS. 3A and 3B are schematic diagrams of the circuit layout of the two surfaces of a substrate of a tunable antenna device in accordance with another embodiment of the present invention, respectively. Please refer to FIGS. 3A and 3B. Compared with the embodiment shown in FIGS. 1A, 1B and 2, in this embodiment the first metal portion of the frequency adjustment portion 15 further has a fourth interdigital structure 154, the substrate of the tunable antenna device further has a third through-hole 1511 and a fourth through-hole 1541, and the tunable antenna device further includes a second switch 23. The second interdigital structure 152 is disposed between the fourth interdigital structure 154 and the first interdigital structure 151. The second switch 23 and the first switch 22 are disposed on the same surface of the substrate. The second switch 23 has a third terminal E3, a fourth terminal E4 and a second control terminal CE2. The third terminal E3 and the fourth terminal E4 are electrically coupled the third through-hole 1511 and the fourth through-hole 1541, respectively. The second control terminal CE2 of the second switch 23 is electrically coupled to the control circuit 21 to determine the on/off state of the second switch 23 according to a second control signal C2 issued by the control circuit 21. One end of the second control terminal CE2 is electrically connected to the fourth terminal E4. When the second switch 23 is turned on, the other end of the second control terminal CE2 is electrically connected to the third terminal E3. In addition, the first interdigital structure 151 and the fourth interdigital structure 154 of the first metal portion of the frequency adjustment portion 15 are electrically coupled to the third terminal E3 and the fourth terminal E4 of the second switch 23 through the third through-hole 1511 and the fourth through-hole 1541, respectively. Therefore, the control circuit 21 can control the on/off state of the first switch 22 and the second switch 23 by using the first control signal C1 and the second control signal C2 to adjust the total number of the used interdigital structures of the frequency adjustment portion 15.

Figure 4:
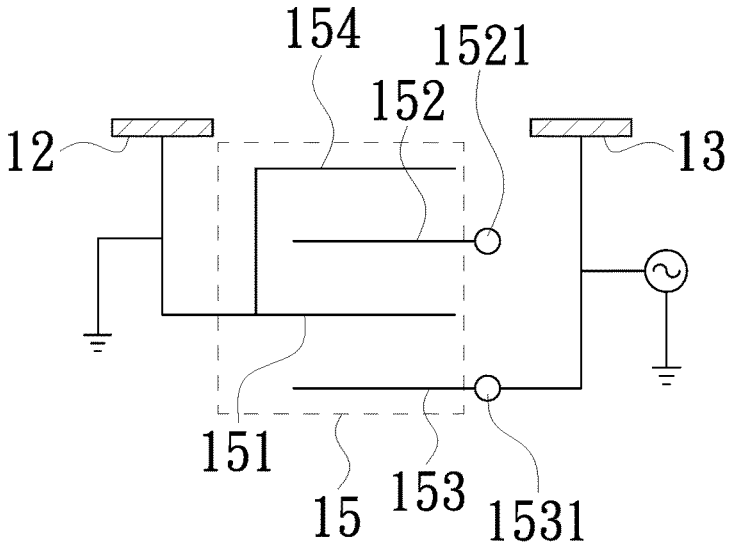
FIG. 4 is a schematic diagram of the circuit layout of a surface of a substrate of a tunable antenna device in accordance with another embodiment of the present invention.

FIG. 4 is a schematic diagram of the circuit layout of a surface of a substrate of a tunable antenna device in accordance with another embodiment of the present invention. Please refer to FIG. 4. Compared with the embodiment shown in FIGS. 1A, 1B and 2, in this embodiment the first metal portion of the frequency adjustment portion 15 further has a fourth interdigital structure 154 and the substrate of the tunable antenna device further has a wire electrically connected between the first interdigital structure 151 and the fourth interdigital structure 154. The second interdigital structure 152 is disposed between the fourth interdigital structure 154 and the first interdigital 151. The tunable antenna device of this embodiment may determine whether to electrically couple the first through-hole 1521 to the second through-hole 1531 by controlling the on/off state of a switch through a control circuit, thereby adjusting the total number of used interdigital structures of the frequency adjustment portion 15.

The embodiment of FIG. 2 shows that the frequency adjustment portion 15 has three interdigital structures and the embodiment of FIGS. 3A and 4 shows that the frequency adjustment portion 15 has four interdigital structures; however, it should be understood that the total number of interdigital structures of the frequency adjustment portion 15 is not limited in the present invention, and those of ordinary skill in the art can correspondingly adjust the total number of interdigital structures of the frequency adjustment portion 15 depending on the frequency band of the tunable antenna device and modify the design of other parts of the tunable antenna device, such as the total number of switches and circuit layout.

Figure 5:
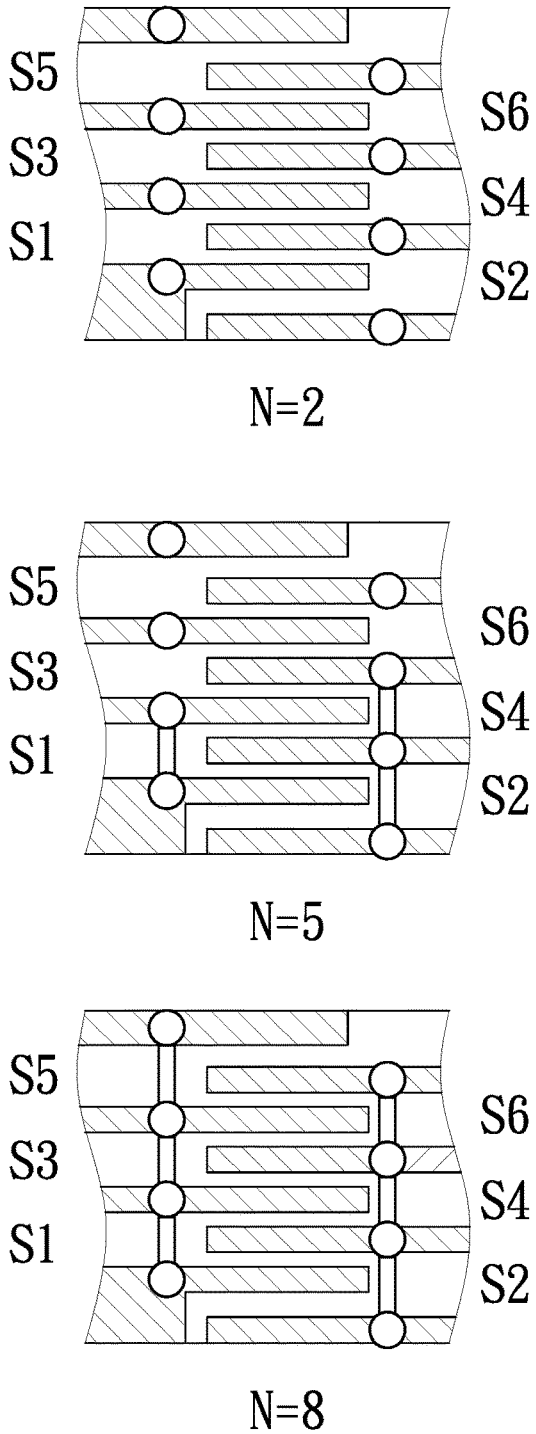
FIG. 5 is a schematic diagram illustrating a switch of different interdigital structures.
Figure 6:
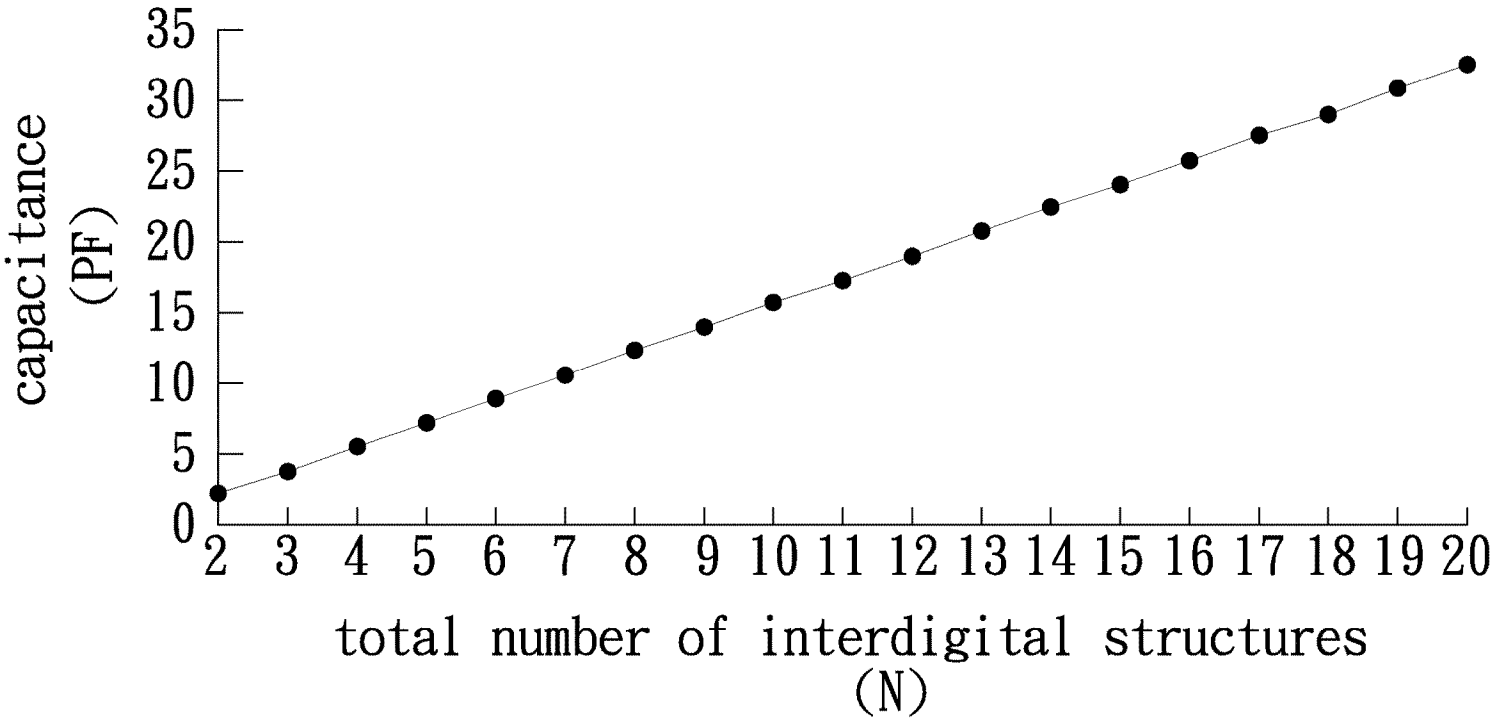
FIG. 6 shows the curve of the relationship between the total number of interdigital structures and the coupling capacitance.

In the embodiment shown in FIG. 3A, if the first metal portion and the second metal portion of the frequency adjustment portion 15 each have four interdigital structures, there will be corresponding eight through-holes and six switches on the substrate of the tunable antenna device. In other words, if the total number of interdigital structures in the first metal portion or the second metal portion is N, the corresponding total number of through-holes is N and the corresponding total number of switches is N−2. FIG. 5 is a schematic diagram illustrating a switch of different interdigital structures. As shown in FIG. 5, when the switches S1 to S6 are all turned off, there are only two interdigital structures that can produce a coupling capacitance; when the switches S1, S2 and S4 are turned on, there are five interdigital structures that can produce a coupling capacitance; and when the switches S1 to S6 are all turned on, there are eight interdigital structures that can produce a coupling capacitance. Therefore, it can be seen that different coupling capacitance can be produced by turning on different number of interdigital structures. FIG. 6 shows the curve of the relationship between the total number of interdigital structures and the coupling capacitance. As shown in FIG. 6, the more the total number of the used interdigital structures of the frequency adjustment portion 15, the larger the coupling capacitance; therefore, the frequency band of the tunable antenna device can be shifted.

Figure 7:
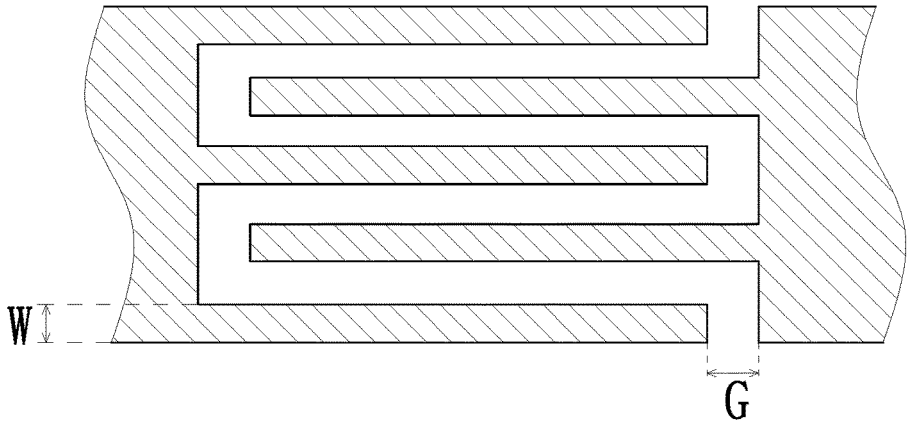
FIG. 7 is a schematic diagram of the size of an interdigital capacitor in accordance with an embodiment of the present invention.
Figure 8:
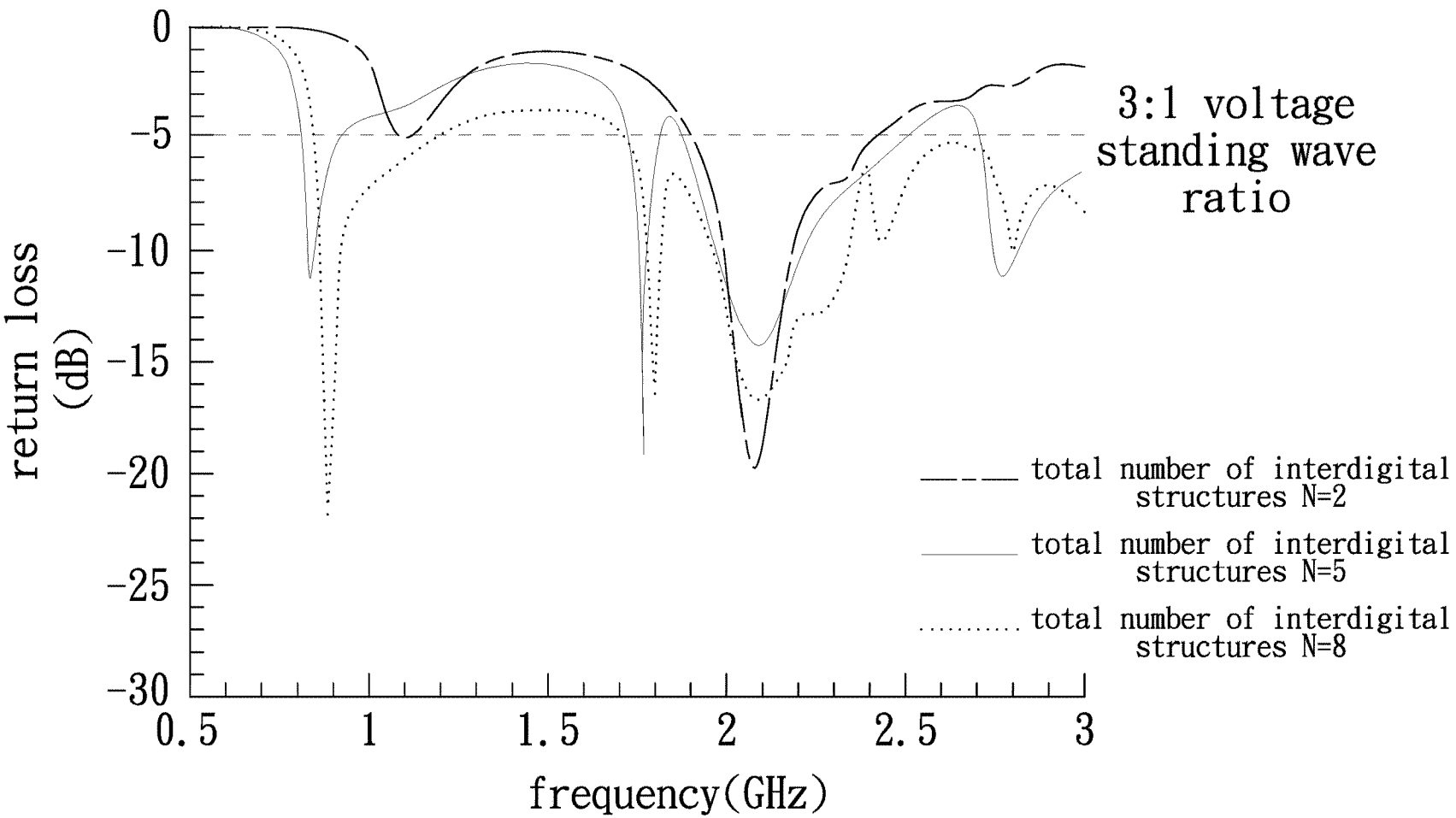
FIG. 8 shows the return losses of different numbers of the interdigital structures.

FIG. 7 is a schematic diagram of the size of an interdigital capacitor in accordance with an embodiment of the present invention. In general, as shown in FIG. 7, the distance G between the first metal portion and the second metal portion and the width W of each interdigital structure of the frequency adjustment portion will be set to be equal to each other in consideration of the convenience of the design and the manufacturing process. For example, the distance G between the first metal portion and the second metal portion and the width W of each interdigital structure may be set to 0.3 mm, and the sheet thickness may be set to 0.8 mm. FIG. 8 shows the return losses of different numbers of the interdigital structures. As shown in FIG. 8, by switching different number of interdigital structures to have different coupling capacitance, the shift of the frequency band of the tunable antenna device is achieved, wherein the frequency band can be between 700 MHz and 3000 MHz.

In summary, the present invention adjusts the total number of used interdigital structures of a frequency adjusting portion by controlling the on/off state of a switch to result in a change in coupling capacitance, thereby shifting the frequency band of a tunable antenna device. Therefore, the tunable antenna device has a wider frequency band (for example, a frequency band that covers the LTE bands in Europe and the United States) and has a compact size.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A tunable antenna device, comprising:

a substrate, comprising a first surface, a second surface, a first through-hole and a second through-hole;

a first switch, disposed on the first surface and comprising a first terminal, a second terminal and a first control terminal;

a control circuit, disposed on the first surface and electrically coupled to the first control terminal;

an antenna, disposed on the second surface and comprising:

a first radiation member; and a second radiation member, wherein one of the first radiation member and the second radiation member comprises a ground terminal and the other of the first radiation member and the second radiation member comprises a feeding terminal; and a frequency adjustment portion, disposed on the second surface and comprising:

a first metal portion, comprising a first interdigital structure, wherein the first interdigital structure is electrically coupled to the first radiation member; and a second metal portion, comprising a second interdigital structure and a third interdigital structure, wherein the first interdigital structure is disposed between the second interdigital structure and the third interdigital structure, the third interdigital structure is electrically coupled to the second radiation member, and the second interdigital structure and the third interdigital structure are electrically coupled to the first terminal and the second terminal through the first through-hole and the second through-hole, respectively.

2. The tunable antenna device according to claim 1, wherein one end of the first control terminal is electrically connected to the first terminal, and the other end of the first control terminal is electrically connected to the second terminal when the control circuit outputs a first control signal to control the first switch to be turned on.

3. The tunable antenna device according to claim 2, wherein a width of each of the interdigital structures of the first metal portion and the second metal portion is equal to a distance between the first metal portion and the second metal portion.

4. The tunable antenna device according to claim 1, wherein the first metal portion further comprises a fourth interdigital structure, the substrate further comprises a third through-hole and a fourth through-hole, the tunable antenna device further comprises a second switch, the second switch is disposed on the first surface and comprises a third terminal, a fourth terminal and a second control terminal, the second control terminal is electrically coupled to the control circuit, and the first interdigital structure and the fourth interdigital structure are electrically coupled to the third terminal and the fourth terminal through the third through-hole and the fourth through-hole, respectively.

5. The tunable antenna device according to claim 4, wherein a width of each of the interdigital structures of the first metal portion and the second metal portion is equal to a distance between the first metal portion and the second metal portion.

6. The tunable antenna device according to claim 4, wherein the second interdigital structure is disposed between the fourth interdigital structure and the first interdigital structure.

7. The tunable antenna device according to claim 6, wherein a width of each of the interdigital structures of the first metal portion and the second metal portion is equal to a distance between the first metal portion and the second metal portion.

8. The tunable antenna device according to claim 4, wherein one end of the second control terminal is electrically connected to the fourth terminal, and the other end of the second control terminal is electrically connected to the third terminal when the control circuit outputs a second control signal to control the second switch to be turned on.

9. The tunable antenna device according to claim 8, wherein a width of each of the interdigital structures of the first metal portion and the second metal portion is equal to a distance between the first metal portion and the second metal portion.

10. The tunable antenna device according to claim 1, wherein the first metal portion further comprises a fourth interdigital structure, and the substrate further comprises a wire electrically coupled between the first interdigital structure and the fourth interdigital structure.

11. The tunable antenna device according to claim 10, wherein a width of each of the interdigital structures of the first metal portion and the second metal portion is equal to a distance between the first metal portion and the second metal portion.

12. The tunable antenna device according to claim 10, wherein the second interdigital structure is disposed between the fourth interdigital structure and the first interdigital structure.

13. The tunable antenna device according to claim 12, wherein a width of each of the interdigital structures of the first metal portion and the second metal portion is equal to a distance between the first metal portion and the second metal portion.

14. The tunable antenna device according to claim 1, wherein a width of each of the interdigital structures of the first metal portion and the second metal portion is equal to a distance between the first metal portion and the second metal portion.

* * * * *